US006699025B1

(12) United States Patent
Van Der Sluis

(10) Patent No.: US 6,699,025 B1
(45) Date of Patent: Mar. 2, 2004

(54) ROLLER VANE PUMP

(75) Inventor: Francis Maria Antonius Van Der Sluis, Sint-Michielsgestel (NL)

(73) Assignee: Van Doorne's Transmissie B.V., Tilburg (NL)

( * ) Notice: Subject to any disclaimer, the term of this patent is extended or adjusted under 35 U.S.C. 154(b) by 0 days.

(21) Appl. No.: 10/258,863

(22) PCT Filed: May 1, 2000

(86) PCT No.: PCT/EP00/04201

§ 371 (c)(1),
(2), (4) Date: Oct. 29, 2002

(87) PCT Pub. No.: WO01/83993

PCT Pub. Date: Nov. 8, 2001

(51) Int. Cl.[7] ..... F03C 2/00
(52) U.S. Cl. ..... 418/150; 418/225
(58) Field of Search ..... 418/150, 225

(56) References Cited

U.S. PATENT DOCUMENTS 2,352,941 A * 7/1944 Curtis ..... 418/150
2,491,351 A 12/1949 Zeitlin
3,066,608 A 12/1962 Livermore
3,247,803 A 4/1966 Halsey
3,286,913 A * 11/1966 Kaatz et al. ..... 418/150
3,695,147 A * 10/1972 Siesennop et al. ..... 91/498
4,515,514 A * 5/1985 Hayase et al. ..... 418/150
4,538,977 A * 9/1985 Ruhl et al. ..... 418/150
4,802,830 A 2/1989 Nakajima
6,413,066 B1 * 7/2002 Van Der Sluis et al. .... 418/225

FOREIGN PATENT DOCUMENTS

DE G 94 17 592.6 2/1995
GB 1113478 5/1968
JP 62298677 A * 12/1987 ..... F04C/2/344

* cited by examiner

*Primary Examiner*—Thomas Denion
*Assistant Examiner*—Theresa Trieu
(74) *Attorney, Agent, or Firm*—Young & Thompson

(57) ABSTRACT

A roller vane pump, in particular suited for pumping fluid in a continuously variable automatic transmission of a motor vehicle, is provided with a pump housing (12) accommodating a carrier (4) rotatable around a central axis (4*a*) of the carrier in a direction of rotation by a pump shaft (5), on the periphery of the carrier (4) there is provided a slot (6), which extends in a substantially radial direction and accommodates an essentially cylindrically shaped roller element (7) having a roller diameter ($D_R$) for interaction with a radially inner cam surface (2*a*) of a cam ring (2) encompassing the carrier (4) in radial direction. The cam surface (2*a*) is located at a radial distance (R) from the central axis (4*a*) that varies in dependence on an angular rotation ($\phi$) according to a cam curve ($R\{\phi\}$). The cam ring (2) is shaped such that a second order mathematical derivative of the cam curve ($R''\{\phi\}$) shows a maximum value ($R''_{MAX}$) at a value for the angular rotation ($\phi$), which is smaller than a radial distance (R) at the value of the angular rotation according to the cam curve ($R\{\phi\}$) minus half the value of the roller diameter ($D_R$).

12 Claims, 4 Drawing Sheets

ROLLER VANE PUMP

BACKGROUND OF THE INVENTION

The invention relates to a roller vane pump, in particular suited for pumping fluid in a continuously variable automatic transmission (CVT) for motor vehicles. Such a roller vane pump is known from the European patent 0.921.314 and is intended for pumping automatic transmission fluid in hydraulically controlled and/or operated continuously variable transmissions for motor vehicles. Particularly in a belt-and-pulley type CVT, a large flow of fluid at a high pressure may be required for control of the transmission. Since the pump is usually drivingly connected to a main drive shaft of the vehicle, it is designed to be able to provide a desired pump yield, i.e. a desired flow of fluid, even at a lower most rotational speed of the vehicle engine, i.e. idle engine speed. At the same time, the pump is designed to reliably withstand prolonged operation at an upper most rotational speed of the vehicle engine.

The pump is provided with a pump housing accommodating a substantially cylindrically shaped carrier, which is rotatable about a central axis extending in a axial direction by means of a pump shaft, and with a ring shaped cam ring radially encompassing the carrier. The carrier is provided with a slot extending inward from its radially outer surface in an essentially radially direction, which slot slidably accommodates an essentially cylindrically shaped roller element having a roller diameter. The carrier, the roller element and the cam ring have virtually the same axial dimension and are enclosed by the pump housing on either axial side. During operation of the pump, the carrier is rotated, whereby the roller element contacts a radially inner surface of the cam ring, i.e. the cam surface, under influence of a centripetal force. The housing, the carrier, the cam ring and the roller element then enclose a rotating pump chamber.

The cam surface is located at a radial distance from the central axis, which varies in dependence on an angular rotation in the direction of rotation of the carrier along the circumference of the cam ring according to a so-called cam curve. Said radial distance varies such, that the volume of a pump chamber cyclically increases and decreases during operation of the pump, due to said radial distance increasing respectively decreasing. The pump operates in that fluid is allowed to flow into the pump chamber at a location where its volume increases, i.e. at a low pressure pump section, and out of the pump chamber at a location where its volume decreases, i.e. at a high pressure pump section. For effecting smooth operation of the pump, it is known in the art to adopt a smoothly changing cam curve, i.e. to provide the pump with a cam ring having a cam surface that is curved such that said radial distance varies smoothly in dependence on the angular rotation.

Although the known pump functions satisfactory per se, the noise generated by the pump designed according to the known art is at a surprisingly high level, particularly when applied in a CVT. Furthermore, it is found that the efficiency of the known pump applied in a CVT is considerably lower than what might be expected beforehand. These disadvantages are particularly a problem for automotive application of the CVT, where high efficiency and low noise levels are generally considered to be a prerequisite.

SUMMARY OF THE INVENTION

It is an object of the present invention to overcome the problems associated with the application of the known roller vane pump to a large extend and, more in particular, to provide for a roller vane pump having an improved design with regard to pump efficiency and pump noise.

According to the invention these objects are achieved with the roller vane pump defined by the characterising features of claim 1. With the pump according to the invention the said contact between the roller element and the cam surface is ameliorated, thereby realising an improved pump efficiency and acceptable pump noise levels. The measure according to the invention effects that a radially outwardly oriented acceleration of the roller element required for maintaining said contact when said radial distance increases, which acceleration is substantially proportional to the second mathematical derivative of the cam curve, is smaller than a radially outward, or centrifugal, acceleration experienced by the roller element during operation of the pump, which centrifugal acceleration is proportional to the radial position of a mass centre point the roller element. According to the invention said radial position is determined by said radial distance according to the cam curve minus halve the value of the roller diameter or may be approximated by said radial distance only, which usually results in an approximation of the actual centrifugal acceleration within about 10%.

With the measure according to the invention, the so-called phenomenon of bouncing rollers, i.e. the breaking and making of the contact between the roller element and cam surface, which has an adverse effect on pump efficiency because it enables leakage of fluid between the roller element and the cam ring, is advantageously avoided, simultaneously with irritating noise peaks caused by said bouncing. Put alternatively, the invention provides a tool for determining the optimum, i.e. minimum, radial dimension of the roller vane pump for a given cam curve, which is determined by the desired pump yield.

It is remarked, that when taking a minimum value of the cam curve for said radial distance, the actual value of said radial distance at the value of the angular rotation where the maximum value of the second derivative of the cam curve occurs is approximated fairly accurately, as well as on the safe side. This is, because in the usually adopted pump designs, said maximum value occurs in the direct vicinity in terms of angular rotation of said minimum value.

The measure defined in the characterising portion of claim 1 is particularly suited and intended for a roller vane pump of the present type, rather than e.g. for a pump having slots that are oriented at a substantial angle with respect to the radial direction, since in such a pump a variable driving force exerted on the roller element by the carrier during rotation thereof has a radially oriented component which acts on the roller element. According to the invention such radially oriented component is highly undesirable, since it is variable, for instance in dependence on the rotational speed of carrier, and since it either decreases the radially outward oriented acting on the roller element or increases friction between the roller element and the cam surface, or for a blade vane pump where the present measure would not be suited, since in such a pump not only a centrifugal force acts on the blades, but also a variable force resulting from a pressure gradient prevailing in radial direction over the vane and often also from a resilient element located between the carrier and the vane.

The pump according to the invention is in particular suited for automotive application. According to the invention, it is for such application highly advantageous, if not only the cam curve itself is a continuous curve, i.e. a curve of which at least the first order mathematical derivative does not show any step changes, but also the first and the second, or even higher, order mathematical derivatives thereof. In this manner a smooth operation of the pump is obtained between said lower most and said upper most rotational speed of the vehicle engine. As a consequence, variations in said radial distance associated with a changing volume of the pump chamber at the high pressure and the low pressure pump sections require a considerable part of the circumference of the cam ring for their accommodation. To still be able to accommodate said variations along the circumference of the cam ring, the rate of change of said radial distance in dependence on the angular rotation must be increased, in which case the phenomenon of bouncing rollers may then unwittingly become a problem. However, in the pump according to the invention the phenomenon of bouncing rollers is taken into account and the pump is designed such that said phenomenon will not occur.

Also when the pump is provided with more than one of a high pressure or of a low pressure pump section, variations in said radial distance associated with a changing volume of the pump chamber at each of said high pressure and low pressure pump sections can only be accommodated along the available 360 degree circumference of the cam ring by adopting a fast rate of change of said radial distance in dependence on the angular rotation, particularly when a relatively large pump yield is desired. Therefore, the phenomenon of bouncing rollers may again become a problem. However, in the pump according to the invention the phenomenon of bouncing rollers is taken into account and the pump is designed such that said phenomenon will not occur.

In the pump according to the invention, the cam curve may be defined such that along its circumference the cam ring is provided with at least two pump poles, whereby each pump pole is defined by a first section of angular rotation of the cam curve, wherein said radial distance increases, i.e. the low pressure pump section, by a second section of angular rotation of the cam curve adjoining said first range, wherein said radial distance is essentially constant, by a third section of angular rotation of the cam curve adjoining said second range, wherein said radial distance decreases, i.e. the high pressure pump section, and by a fourth section of angular rotation of the cam curve adjoining said third range, wherein said radial distance is again essentially constant. This type of roller vane pump has the advantage that its pump poles may selectively be operated in parallel, in series or in an idle mode, so that the overall pump yield may be varied. With this type of pump, the cam curve may be defined such that the pump poles have a mutually varying pump pole yield, which is defined as a volume of fluid displaced by the respective pump pole per 360 degrees angular rotation of the pump carrier, i.e. a single revolution. According to the invention it is advantageous, if in such a case the pump pole yields and corresponding pump pole angles, which are each defined as the sum of the sections of angular rotation defining the respective pump pole, are mutually, related, such that the pump pole having the smallest pump pole yield also has the smallest pump pole angle and vice versa. This measure allows the cam curve to have a smooth second order mathematical derivative that shows a relatively small maximum value, because the pump pole that requiring the largest changes in said radial distance to achieve the desired pump pole yield, also has the largest part of the circumference of the cam ring for the accommodation of said changes and vice versa. It is noted that said maximum value may advantageously be minimised by relating the pump pole yields and pump pole angles such that the mutual proportions of the pump pole yields of the pump poles and the mutual proportions of the corresponding pump pole angles are essentially equal.

A further development of the invention has the characterising feature according to claim 7. The measure according to claim 7 has the effect that a maximum radially inwardly oriented acceleration of the roller element, which occurs when said radial distance decreases, is of the similar magnitude as the maximum radially outwardly oriented acceleration. Advantages of such measure are that the centripetal force between the cam ring and the roller element are more or less tuned along the circumference of the cam ring and that such force is limited to a suitable level, so as to limit wear of the pump and its component.

In an embodiment of the invention specifically preferred for automotive application the second order derivative of the cam curve shows a maximum value that is equal to the radial distance according to the cam curve multiplied by a safety factor having a value in the range from 0.4 to 0.9. This safety factor is intended to account for the influence of various disturbances on said contact between roller element and cam ring. Such disturbances may include a radially inwardly oriented acceleration as a result of the roller element under influence of the force of gravity, of mechanical shocks exerted on the pump or of a pressure gradient prevailing over the roller element in radial direction due to fluid flow. They may also be a result of pressure fluctuations during operation. Depending on the environment wherein the pump is used, said disturbances are more or less of influence, so that the safety factor may be chosen closer to 0.4 or closer to 0.9 respectively. A safety factor having a value in the range from 0.55 to 0.75 was found to be a generally applicable value.

The invention also relates to a continuously variable transmission provided with the roller vane pump according to the invention and to a motor vehicle transmission provided with such roller vane pump, whereby the pump shaft is drivingly rotatable by the engine.

The invention further relates to a method for determining a given order mathematical derivative of the cam curve, which method comprises the steps of:

- determining all sections of the angular rotation within the cam curve where the radial distance between the central axis and the cam surface is essentially constant;
- determining the value of said radial distance in all said sections of the angular rotation within the cam curve where said radial distance is essentially constant;
- determining the value of said radial distance in between the two subsequent sections of the angular rotation where said radial distance is essentially constant at a number of different values of the angular rotation, which number is larger than the order of the mathematical derivative to be determined, for each two subsequent sections of the angular rotation where said radial distance is essentially constant;
- fitting a polynomial equation of an order that is at least equal to the order of the mathematical derivative to be determined to the radial distances determined in between the two subsequent sections of the angular rotation where said radial distance is essentially constant, for each two subsequent sections;
- differentiating each fitted polynomial equation to the order of the mathematical derivative to be determined.

When adopting the above method, the given order mathematical derivative of the cam curve will be build up of the differentiated polynomial equations separated by sections of angular rotation where the mathematical derivative is equal to zero. According to the invention it is to be preferred to adopt polynomial equations of at least the eighth order. In this manner, the fitting of the polynomial equations may be performed while satisfying the boundary conditions that both the cam curve, its first order derivative and its second order derivative are continuous curves, i.e. while filling in six of the at least nine degrees of freedom. The remaining degrees of freedom of the linear equations being available for optimising the fit. In practice it was found that with three remaining degrees of freedom acceptable fitting results are obtained.

BRIEF DESCRIPTION OF THE DRAWING(S)

The invention will now be elaborated further with reference to the non-restricting examples of embodiment shown in the figures.

DETAILED DESCRIPTION OF THE PREFERRED EMBODIMENTS

Figure 1:
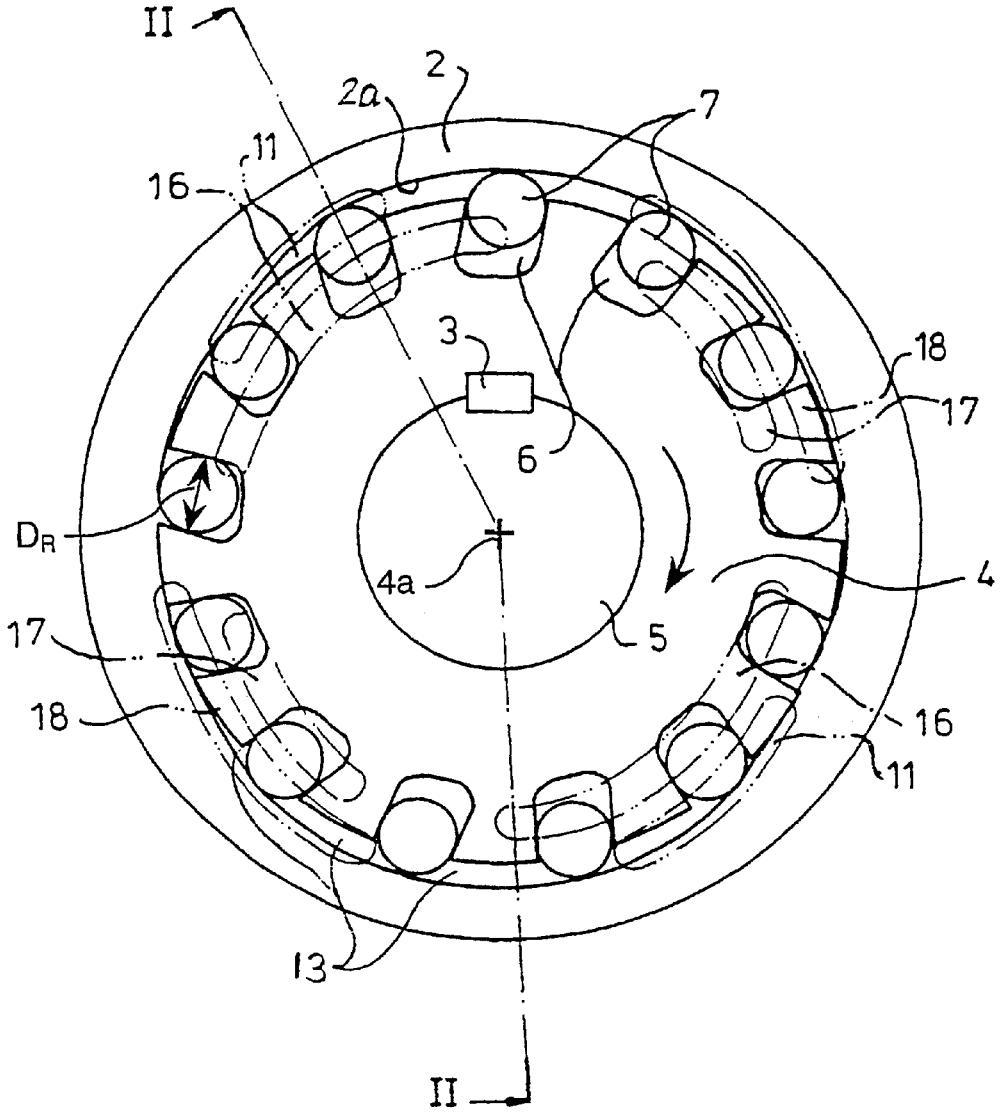
FIG. 1 is an axial view of inner pump parts of a roller vane pump according to the known art.
Figure 2:
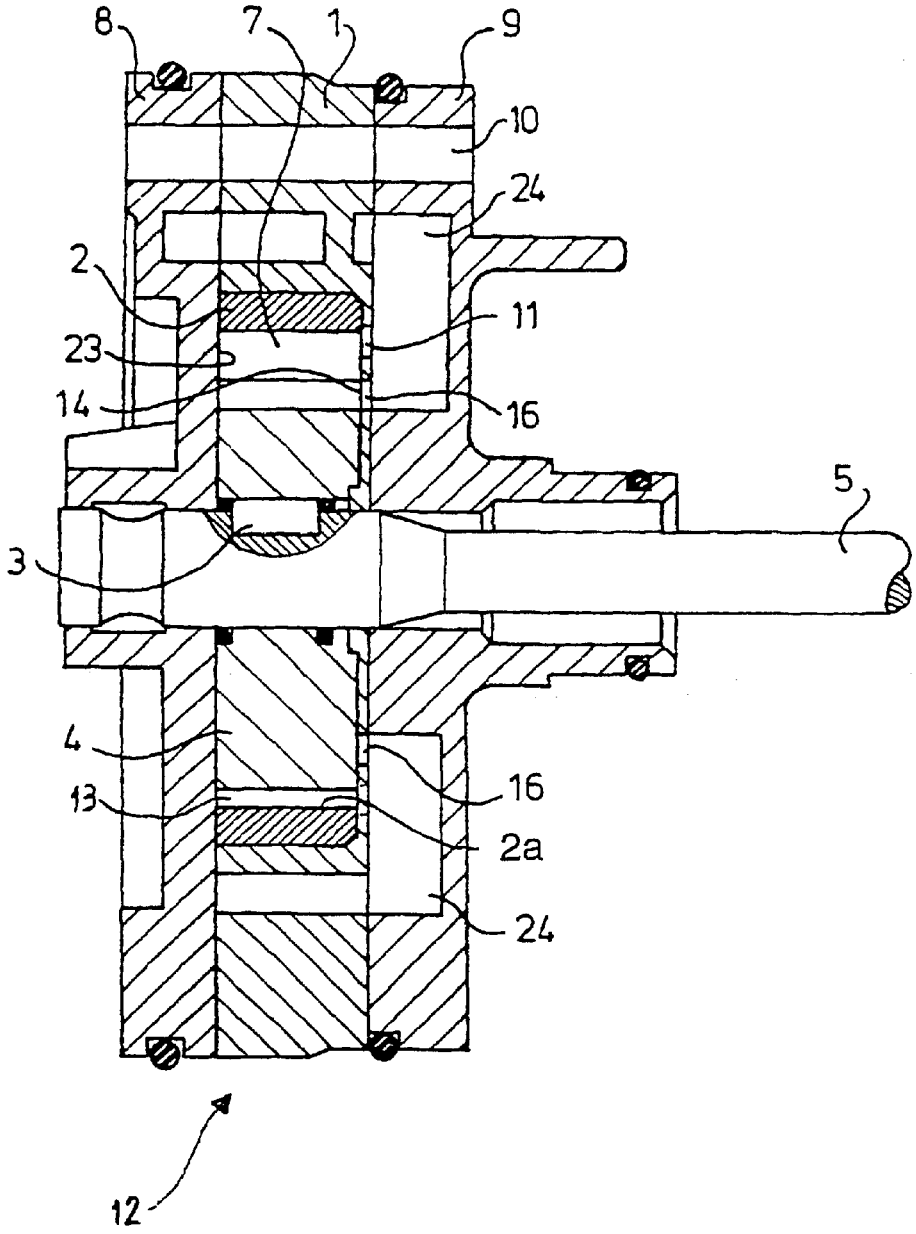
FIG. 2 is a tangential view of the inner pump parts drawn in accordance with the cross section II—II denoted in FIG. 1.

FIGS. 1 and 2 provide two cross-sectional views of the known roller vane pump. The known pump comprises a pump housing 12 that is composed of three pump housing parts 1, 8 and 9, which can be secured to each other by means of bolts that are inserted in holes in the pump housing 12, e.g. hole 10. The central pump housing part 1 contains an essentially cylindrically shaped carrier 4, which is rotatable around a central axis 4*a* in a direction of rotation indicated by the arrow by means of a pump shaft 5, and a cam ring 2 with a radially inward oriented cam surface 2*a*, which cam ring 2 radially encompasses the carrier 4. The pump shaft 5 is fixed to the carrier 4 with a wedge 3. On its periphery the carrier 4 is provided with radially inwardly extending slots 6 that accommodate essentially cylindrically shaped roller elements 7 having a roller diameter $D_R$. The roller elements 7 are accommodated in the slots 6, such that they are able to slide in a predominantly radially oriented direction. During operation of the pump, the carrier 4, the cam ring 2, and the roller elements 7 define a number of pump chambers 13 that are bound in axial sense by the inner surfaces 23 and 14 of the outer pump housing parts 8 and 9 respectively and that may arrive in communication with a hydraulic line 24 in the pump housing 12, through one or more of a number of supply ports 11 and 16 and/or discharge ports 17 and 18 provided in the pump housing 12 for allowing a flow of fluid between the pump chamber 13 and the hydraulic channel 24. During rotation of the carrier 4, the cross-sectional surface area and thus the volume of the pump chamber 13 cyclically increase and decrease, as can be seen in FIG. 1, so that, on the one hand, fluid is allowed to flow into the pump chamber 13 when its volume increases, i.e. at the location of a so-called low pressure pump section, and, on the other hand, fluid is allowed to flow out of the pump chamber 13 when its volume decreases, i.e. at the location of a so-called high pressure pump section.

Figure 3:
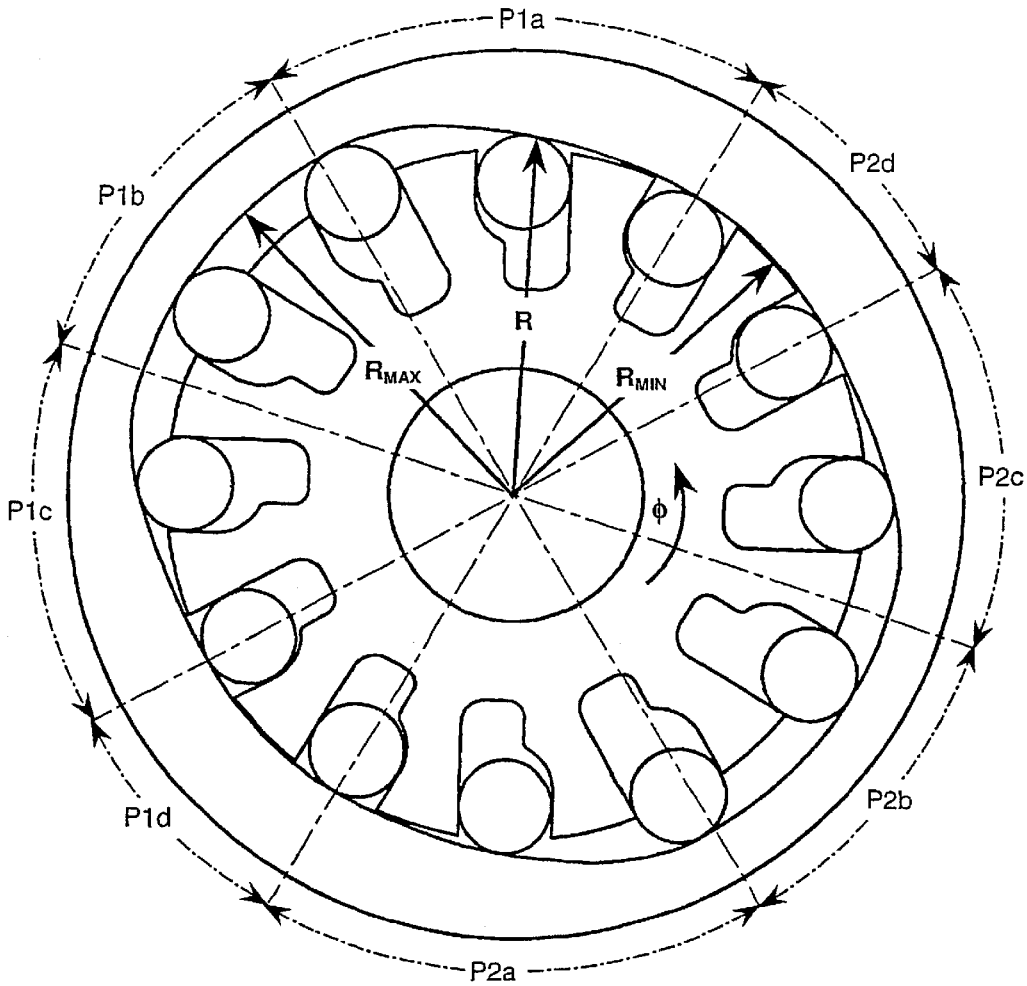
FIG. 3 is an example of a cam curve as well as its first and second mathematical derivative according to the invention.

As indicated in FIG. 3, the cam surface 2*a* is located at a radial distance R from the central axis 4*a*, which radial distance R varies between a maximum value $R_{MAX}$ and a minimum value $R_{MIN}$ in dependence on an angular rotation $\phi$ in the direction of rotation of the carrier 4 along the circumference of the cam ring 2 according to a so-called cam curve $R\{\phi\}$. In the embodiment of the pump of FIG. 3, the cam curve $R\{\phi\}$ is chosen such that there are two pump poles P1 and P2 defined along the circumference of the cam ring 2, whereby each pump pole P1 and P2 is defined by a first section P1*a* respectively P2*a* of angular rotation $\phi$ of the cam curve $R\{\phi\}$, wherein said radial distance R increases, i.e. a low pressure pump section, a second section P1*b* respectively P2*b* of angular rotation $\phi$ of the cam curve $R\{\phi\}$ adjoining said first section P1*a* respectively P2*a*, wherein said radial distance R is essentially constant, a third section P1*c* respectively P2*c* of angular rotation $\phi$ of the cam curve $R\{\phi\}$ adjoining said second section P1*b* respectively P2*b*, wherein said radial distance R decreases, i.e. a high pressure pump section, and a fourth section P1*d* respectively P2*d* of angular rotation $\phi$ of the cam curve $R\{\phi\}$ adjoining said third section P1*c* respectively P2*c*, wherein said radial distance R is essentially constant.

Figure 4:
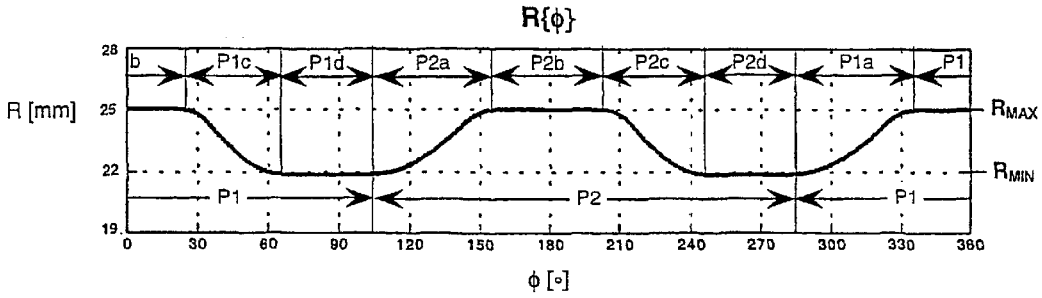
FIGS. 4–6 are another example of a cam curve.

FIG. 4 is a plot of the cam curve $R\{\phi\}$ according to which said radial distance R varies in dependence on the angular rotation $\phi$ in case of the pump shown in FIG. 3. The pump poles P1 and P2, as well as said first section P1*a* respectively P2*a*, said second section P1*b* respectively P2*b*, said third section P1*c* respectively P2*c* and said fourth section P1*d* respectively P2*d* are also indicated in FIG. 4. For each pump pole P1 and P2, the cam curve $R\{\phi\}$ changes smoothly between its maximum value of $R_{MAX}$ and its minimum value $R_{MIN}$.

Figure 5:
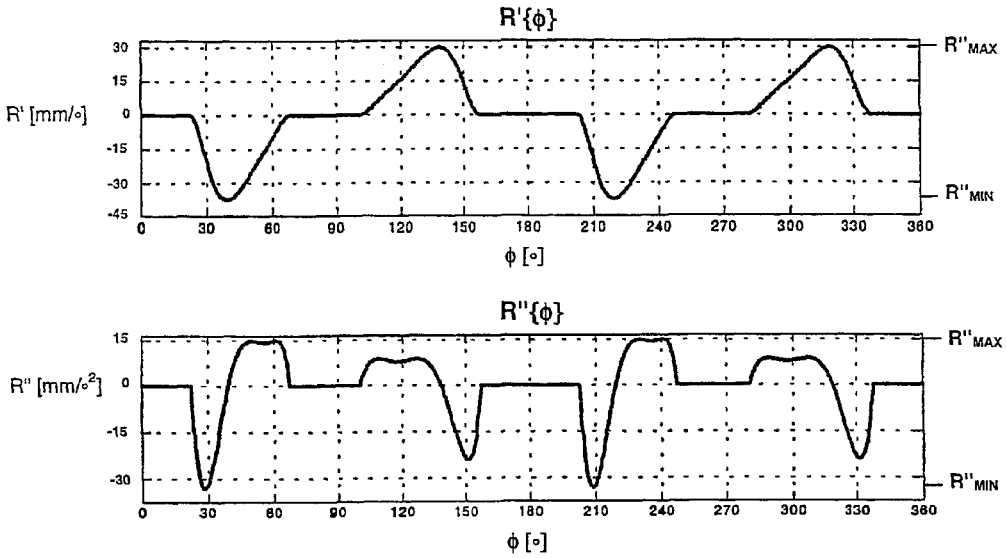

In FIG. 5 a first and a second mathematical derivative $R'\{\phi\}$ respectively $R''\{\phi\}$ of the cam curve $R\{\phi\}$ of FIG. 4 are plotted. It can be seen that, in accordance with the invention, the cam curve $R\{\phi\}$ was determined such that its second derivative $R''\{\phi\}$has a maximum value $R''_{MAX}$ at a value for the angular rotation $\phi$, which is smaller than the said radial distance R according to the cam curve $R\{\phi\}$ at said value for the angular rotation minus halve the value of the roller element diameter $D_R$, which in this case is about 3 mm. In this particular example a safety factor of nearly 0.7 was adopted. As mentioned before, said radial distance R according to the cam curve $R\{\phi\}$ may be approximated by the minimum value $R_{MIN}$ of the cam curve $R\{\phi\}$.

Such measures effect that the contact between the roller element 7 and the cam ring 2 is maintained, because the radially outwardly oriented force $F_R$ required for the roller element 7 to be able to follow the cam ring 2 is smaller than the centrifugal force $F_C$ experienced by the roller element 7 as a result of the rotation of the carrier 4 during operation, since:

$$F_C = m \cdot \omega^2 \cdot \left(R\{\phi\} - \frac{1}{2}D_R\right) = m \cdot \left(\frac{\partial \phi}{\partial t}\right)^2 \cdot \left(R\{\phi\} - \frac{1}{2}D_R\right)$$

and $$F_R = m \cdot a = m \cdot \left(\frac{\partial}{\partial t}\right)^2 \cdot R\{\phi\} = m \cdot \left(\frac{\partial \phi}{\partial t}\right)^2 \cdot \frac{\partial^2 (R\{\phi\})}{\partial \phi^2}$$

where:

m is the mass of the roller element 7 in [kg]

$D_R$ is the diameter of the roller element 7 in [mm]

$\omega$ is the angular speed of the roller element in [rad/s]

t is the time in [s]

thus $$F_R < F_C \Longrightarrow \frac{\partial^2 (R\{\phi\})}{\partial \phi^2} < \left(R\{\phi\} - \frac{1}{2} D_R\right)$$

or, if said radial distance R at the angular rotation $\phi$ where said maximum $R''_{MAX}$ in the second derivative of the cam curve $R''\{\phi\}$ occurs is approximated by the minimum value $R_{MIN}$ of the cam curve $R\{\phi\}$:

$$\frac{\partial^2 (R\{\phi\})}{\partial \phi^2} \approx < \left(R_{\mathrm{MIN}} - \frac{1}{2} D_R\right)$$

It is remarked that, according to the invention the influence of halve the value of the roller diameter $D_R$ may be neglected, in which case the equations are approximations that are accurate within about 10%.

In FIG. 5 it can also be seen that, in accordance with the invention, the cam curve $R\{\phi\}$ was determined such that its second derivative $R''\{\phi\}$ shows a minimum value $R''_{MIN}$ that is about two times as large as the maximum value $R''_{MAX}$ of the second derivative $R''\{\mathbf{100}\}$. With this measure said centripetal force is limited to a suitable level, so as to limit wear.

Figure 6:
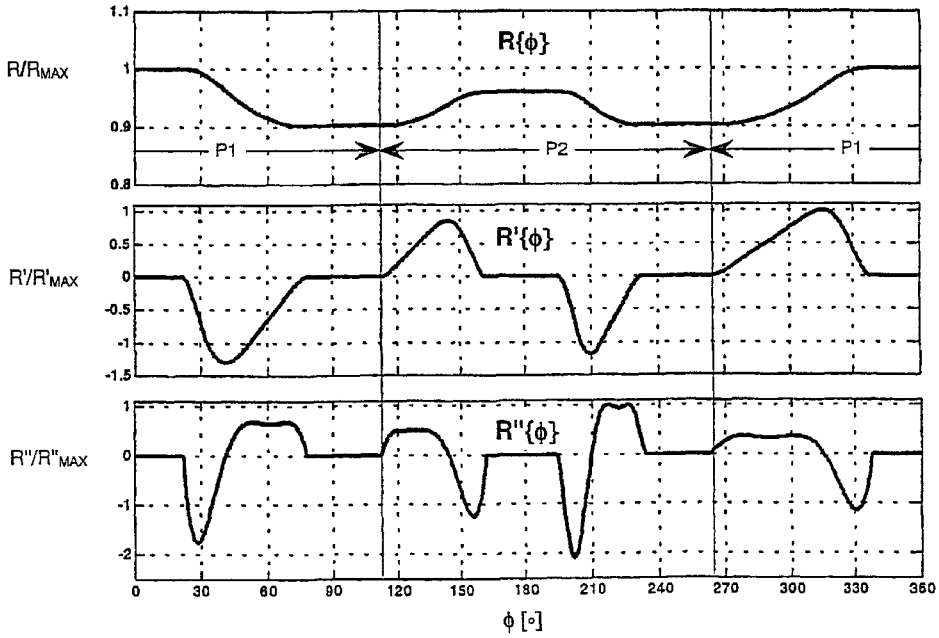

Finally, in FIG. 6 another example of the cam curve $R\{\phi\}$ and its first and second mathematical derivative $R'\{\phi\}$ respectively $R''\{\phi\}$ are plotted. FIG. 6 differs from FIGS. 4 and 5 in that the plots are presented as normalised plots, i.e. scaled to 1. In this example a pump pole yield, which is defined as a volume of fluid displaced by a pump pole per revolution of the pump carrier 4, of a first pump pole P1 is larger than that of a second pump pole P2, i.e. the difference between the maximum value and the minimum value of the cam curve $R\{\phi\}$ at the location of the first pump pole P1 is larger than that for the second pump pole P2. In case of the pump for which the cam curve $R\{\phi\}$ is plotted in FIG. 6, the pump pole yield of the second pump pole P2 is about 0.6 to 0.7 times the pump pole yield of the first pump pole P1. From FIG. 6 it appears that a pump pole angle, which is defined as the sum of the sections P1*a*, P1*b*, P1*c*, P1*d* respectively P2*a*, P2*b*, P2*c*, P2*d* of angular rotation ($\phi$) defining the respective pump pole P1 respectively P2, for the second pump pole P2 is about 0.7 times the pump pole angle of the first pump pole P1. So, in accordance with the invention, the pump pole yields and the pump pole angles are mutually related, whereby the ratio between the pump pole yields is approximately equal to the ratio between the pump pole angles.

What is claimed is:

1. Roller vane pump for pumping fluid in a continuously variable automatic transmission of a motor vehicle, provided with a pump housing (12) accommodating a carrier (4) rotatable around a central axis (4*a*) of the carrier in a direction of rotation by a pump shaft (5), on the periphery of the carrier (4) there is provided a slot (6), which extends in a substantially radial direction and which accommodates an essentially cylindrically shaped roller element (7) having a roller diameter ($D_R$) for interaction with a radially inner cam surface (2*a*) of a cam ring (2) encompassing the carrier (4) in radial direction, which cam surface (2*a*) is located at a radial distance (R) from the central axis (4*a*) that varies in dependence on an angular rotation ($\phi$) according to a cam curve ($R\{\phi\}$), characterised in that the cam ring (2) is shaped such that a second order mathematical derivative of the cam curve ($R''\{\phi\}$) shows a maximum value ($R''_{MAX}$) at a value for the angular rotation ($\phi$), which is smaller than a radial distance (R) at said value of the angular rotation according to the cam curve ($R\{\phi\}$)) minus half the value of the roller diameter ($D_R$).

2. Roller vane pump according to claim 1, characterised in that said radial distance (R) is approximated by a minimum value ($R_{MIN}$) according to the cam curve ($R\{\phi\}$).

3. Roller vane pump according to claim 1, characterised in that a first order mathematical derivative of the cam curve ($R'\{\phi\}$) is a continuous curve.

4. Roller vane pump according to claim 3, characterised in that the second order mathematical derivative ($R''\{\phi\}$) of the cam curve is a continuous curve.

5. Roller vane pump according to claim 1, characterized in that along its circumference the cam ring (2) is provided with at least two pump poles (P1; P2), whereby each pump pole is defined by a first section (P1*a*; P2*a*) of angular rotation ($\phi$) of the cam curve ($R\{\phi\}$), wherein said radial distance (R) increases, a second section (P1*b*; P2*b*) of angular rotation ($\phi$) of the cam curve ($R\{\phi\}$) adjoining said first range, wherein said radial distance (R) is essentially constant, a third section (P1*c*; P2*c*) of angular rotation ($\phi$) of the cam curve ($R\{\phi\}$) adjoining said second range, wherein said radial distance (R) decreases and a fourth section (P1*d*; P2*d*) of angular rotation ($\phi$) of the cam curve ($R\{\phi\}$)) adjoining said third range, wherein said radial distance (R) is essentially constant, whereby the pump poles (P1; P2) each have a pump pole yield, which is defined as a volume of fluid displaced by the respective pump pole (P1; P2) per revolution of the carrier (4), and a pump pole angle, which is defined as the sum of the sections (P1*a*, P1*b*, P1*c*, P1*d*; P2*a*, P2*b*, P2*c*, P2*d*) of angular rotation ($\phi$) defining the respective pump pole (P1; P2), and whereby the pump pole yields and the pump pole angles are mutually related such that a pump pole (P1 or P2) having the largest pump pole yield also has the largest pump pole angle.

6. Roller vane pump according to claim 5, characterised in that the pump pole yields and the pump pole angles are mutually related such that the mutual proportions of the pump pole yields of the pump poles and the mutual proportions of the corresponding pump pole angles are essentially equal.

7. Roller vane pump according to claim 1, characterised in that the second order mathematical derivative of the cam curve ($R''\{\phi\}$) shows a minimum value ($R''_{MIN}$) having an absolute value which is smaller than three times, preferably smaller than two times, the maximum value ($R''_{MAX}$) of the second order mathematical derivative of the cam curve ($R''\{\phi\}$).

8. Roller vane pump according to claim 1, characterised in that the second order mathematical derivative of the cam curve ($R''\{\phi\}$) shows a maximum value which is equal to the minimum radial distance ($R_{MIN}$) according to the cam curve ($R\{\phi\}$) multiplied by a safety factor having a value in the range from 0.4 to 0.9.

9. Continuously variable transmission provided with roller vane pump according to claim 1.

10. Motor vehicle having an engine en being provided with a roller vane pump according to claim 1, wherein the pump shaft 5 is drivingly rotatable by the engine.

11. Roller vane pump suited for pumping fluid in a continuously variable automatic transmission of a motor vehicle, provided with a pump housing (12) accommodating a carrier (4) rotatable around a central axis (4*a*) of the carrier in a direction of rotation by a pump shaft (5) and radially surrounded by a ring shaped cam ring (2) having a radially inner cam surface (2*a*), which is located at a radial distance (R) from the central axis (4*a*) that varies in dependence on an angular rotation (ϕ) according to a cam curve (R{ϕ}) characterised in that along its circumference the cam ring (2) is provided with at least two pump poles (P1; P2), whereby each pump pole is defined by a first section (P1*a*; P2*a*) of angular rotation (ϕ) of the cam curve (R{ϕ}), wherein said radial distance (R) increases, a second section (P1*b*; P2*b*) of angular rotation (ϕ) of the cam curve (R{ϕ}) adjoining said first range, wherein said radial distance (R) is essentially constant, a third section (P1*c*; P2*c*) of angular rotation (ϕ) of the cam curve (R{ϕ}) adjoining said second range, wherein said radial distance (R) decreases and a fourth section (P1*d*; P2*d*) of angular rotation (ϕ) of the cam curve (R{ϕ}) adjoining said third range, wherein said radial distance (R) is essentially constant, whereby the pump poles (P1; P2) each have a pump pole yield, which is defined as a volume of fluid displaced by the respective pump pole (P1; P2) per revolution of the carrier (4), and a pump pole angle, which is defined as the sum of the sections (P1*a*, P1*b*, P1*c*, P1*d*; P2*a*, P2*b*, P2*c*, P2*d*) of angular rotation (ϕ) defining the respective pump pole (P1; P2), and whereby the pump pole yields and the pump pole angles are mutually related, such that a pump pole (P1 or P2) having the largest pump pole yield also has the largest pump pole angle.

12. Method for determining a given order mathematical derivative of a cam curve (R{ϕ}) of a roller vane pump, provided with a pump housing (12) accommodating a carrier (4) rotatable around a central axis (4*a*) of the carrier (4) in a direction of rotation by a pump shaft (5) and radially surrounded by a ring shaped cam ring (2) having a radially inner cam surface (2*a*) located at a radial distance (R) from the central axis (4*a*), which radial distance (R) varies in dependence on an angular rotation (ϕ) in the direction of rotation of the carrier (4) according to the cam curve (R{ϕ}) comprising the steps of:

determining all sections (P1*b*, P1*d*, P2*b*, P2*d*) of the angular rotation (ϕ) of the cam curve (R{ϕ}) where said radial distance (R) is essentially constant;

determining the value of said radial distance (R) in all said sections (P1*b*; P1*d*; P2*b*; P2*d*) of the angular rotation (ϕ) of the cam curve (R{ϕ}) where said radial distance (R) is essentially constant;

determining the value of said radial distance (R) in between two subsequent sections (P1*b*; P1*d*; P2*b*; P2*d*) of the angular rotation (ϕ) where said radial distance (R) is essentially constant at a number of different values of the angular rotation (ϕ), which number is larger than the order of the mathematical derivative to be determined, for each two subsequent sections (P1*b*; P1*d*; P2*b*; P2*d*) of the angular rotation (ϕ) where said radial distance (R) is essentially constant;

fitting a polynomial equation of an order that is at least equal to the order of the mathematical derivative to be determined to the radial distances (R) determined in between the two subsequent sections (P1*b*; P1*d*; P2*b*; P2*d*) of the angular rotation (ϕ) where said radial distance (R) is essentially constant, for each two subsequent sections (P1*b*; P1*d*; P2*b*; P2*d*);

differentiating each fitted polynomial equation to the order of the mathematical derivative to be determined.

* * * * *